US006854597B1

(12) United States Patent
Ali et al.

(10) Patent No.: US 6,854,597 B1
(45) Date of Patent: Feb. 15, 2005

(54) PACKAGE WHICH DEMONSTRATES UTILITY OF TWO COOPERATING ATTACHABLE PIECES

(75) Inventors: Terry Ali, Fairborn, OH (US); Christopher Ali, Fairborn, OH (US); Phillip Glenn Ali, Fairborn, OH (US)

(73) Assignee: Ali, Industries, Inc., Fairborn, OH (US)

( * ) Notice: Subject to any disclaimer, the term of this patent is extended or adjusted under 35 U.S.C. 154(b) by 113 days.

(21) Appl. No.: 10/372,428

(22) Filed: Feb. 21, 2003

(51) Int. Cl.[7] ..... B65D 73/00; B24D 15/00

(52) U.S. Cl. ..... 206/349; 206/784; 206/806; 451/525

(58) Field of Search ..... 206/349, 229–230, 206/730–732, 784, 806, 733; 451/344, 512, 523–525

(56) References Cited

U.S. PATENT DOCUMENTS 3,261,454 A * 7/1966 Elson et al. ..... 206/349
3,459,298 A * 8/1969 Quenot ..... 206/305
4,549,654 A * 10/1985 Tiesman ..... 206/486

* cited by examiner

*Primary Examiner*—Bryon P. Gehman

(57) ABSTRACT

A package which demonstrates utility of two cooperating attachable pieces includes a first package portion for retaining a first piece having a first releasably connectable surface thereon, wherein the first package portion includes a reveal surface to expose part of the releasably connectable surface, a second package portion for retaining a second piece which cooperates with the first piece and has a second releasably connectable surface thereon, wherein the second package portion includes a reveal surface to expose part of the second releasably connectable surface. Further, the releasably connectable surfaces can be connected to one another through the reveal surfaces which when so connected retains the package portions adjacent one another.

10 Claims, 5 Drawing Sheets

PACKAGE WHICH DEMONSTRATES UTILITY OF TWO COOPERATING ATTACHABLE PIECES

BACKGROUND OF THE INVENTION

The present invention relates to a package which demonstrates utility of two cooperating attachable pieces. More particularly, the invention relates to a package designed for an abrasive tool and abrasive material.

Currently, abrasive tools, e.g., sanding blocks, are sold as a separate item apart from an abrasive material, e.g., sanding paper, used therewith. Sanding devices come in a variety of configurations, and include a surface designed for holding a piece of sandpaper adjacent thereto. Some of these devices include sanding blocks, sanding disks, sanding wheels, etc. Accordingly, each of these devices has corresponding sandpaper which is configured to fit with each device.

In addition to the sandpaper being configured to fit the device, there have been a number of ways to hold the sandpaper to the device. For example, clamping techniques, sticky back sandpaper and hook and loop materials have been previous used.

The retail outlets, such as Home Depot™ and Lowes™ sell the sanding devices in different areas. The sanding devices are typically found in a tool section of the store, while sandpaper can be found in tools, paint and/or hardware sections and the sandpaper is typically sold either as single sheet or bulk.

Customers are frequently confused or unsure of the type of sandpaper to buy for a particular sanding device or job to be performed. There is a need to provide an improved way to inform and demonstrate to the customer the type of sandpaper to be used with a particular device as well as the utility of such combination. The present invention overcomes the problems associated with the prior art.

SUMMARY OF INVENTION

It is an object of the present invention to improve demonstrability of sandpaper working with a sanding device.

It is a further object of the present invention to provide a novel package for displaying utility of cooperating parts.

It is a further object of a novel marketing package for sandpaper and a sanding device having minimal shelf space requirements.

Accordingly, the invention is directed to a package which demonstrates utility of two cooperating attachable pieces including a first cooperating attachable piece having a releasable connecting surface thereon and a second cooperating attachable piece having a releasable connecting surface thereon for connection with the other releasable connecting surface. The package includes a first package portion for retaining the first cooperating attachable piece, wherein the first package portion includes a reveal surface to expose part of the first cooperating attachable piece releasable connecting surface. Also, included is a second package portion for retaining the second cooperating attachable piece, wherein the second package portion includes a reveal surface to expose part of the second cooperating attachable piece releasable connecting surface. The first package portion retains the first cooperating attachable piece without the aid of the second package portion and the second package portion retains the second cooperating attachable piece without the aid of the first package portion such that when the cooperating attachable pieces are so retained the releasable connecting surfaces are connected to one another through the reveal surfaces which when so connected releasably retain the package portions adjacent one another.

Other objects and advantages will be readily apparent to those skilled in the art upon viewing the drawings and reading the detailed description hereafter.

DETAILED DESCRIPTION OF THE DRAWINGS

Figure 1:
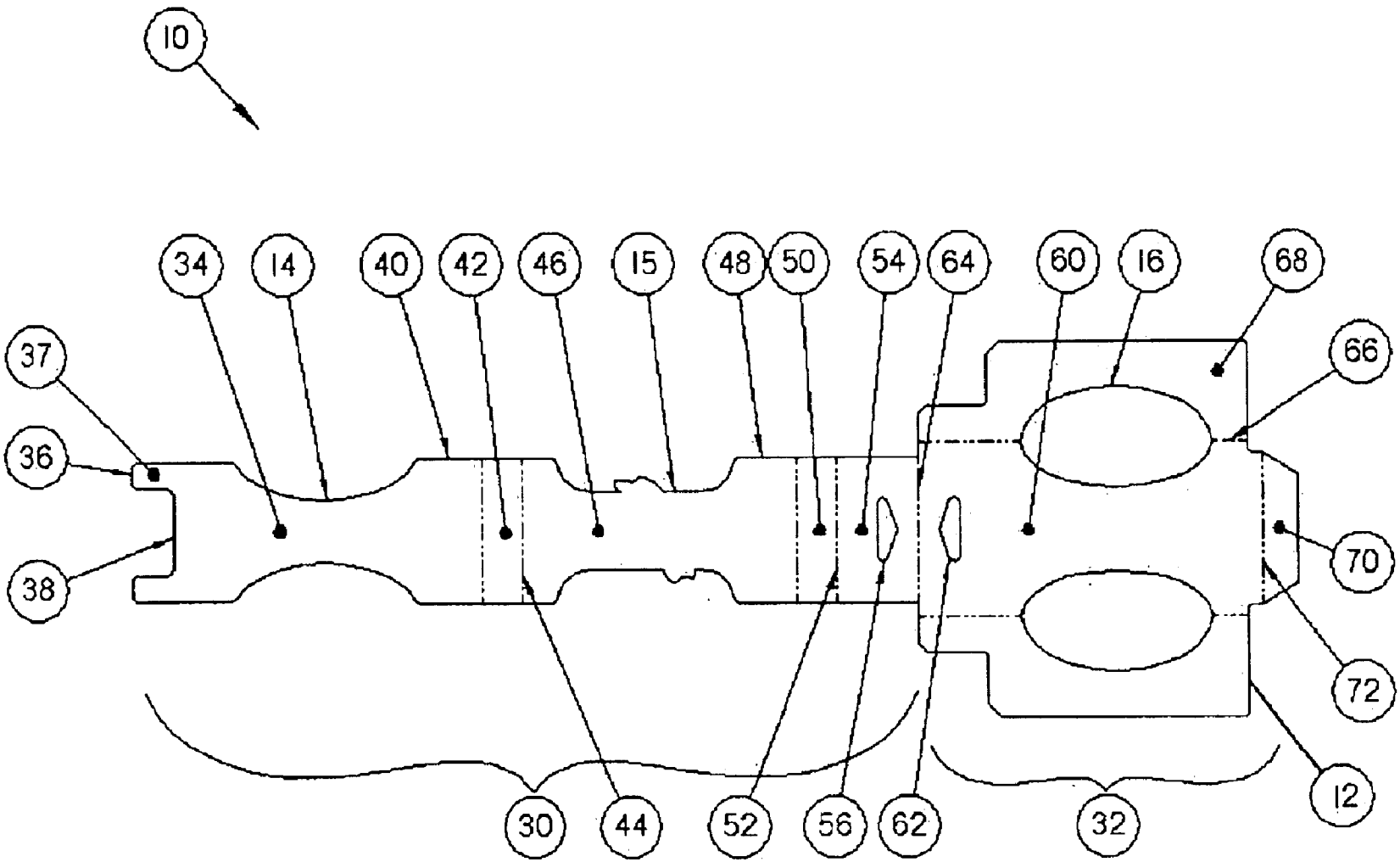
FIG. 1 is a plan view of the package of the present invention in an open unassembled form.
Figure 5:
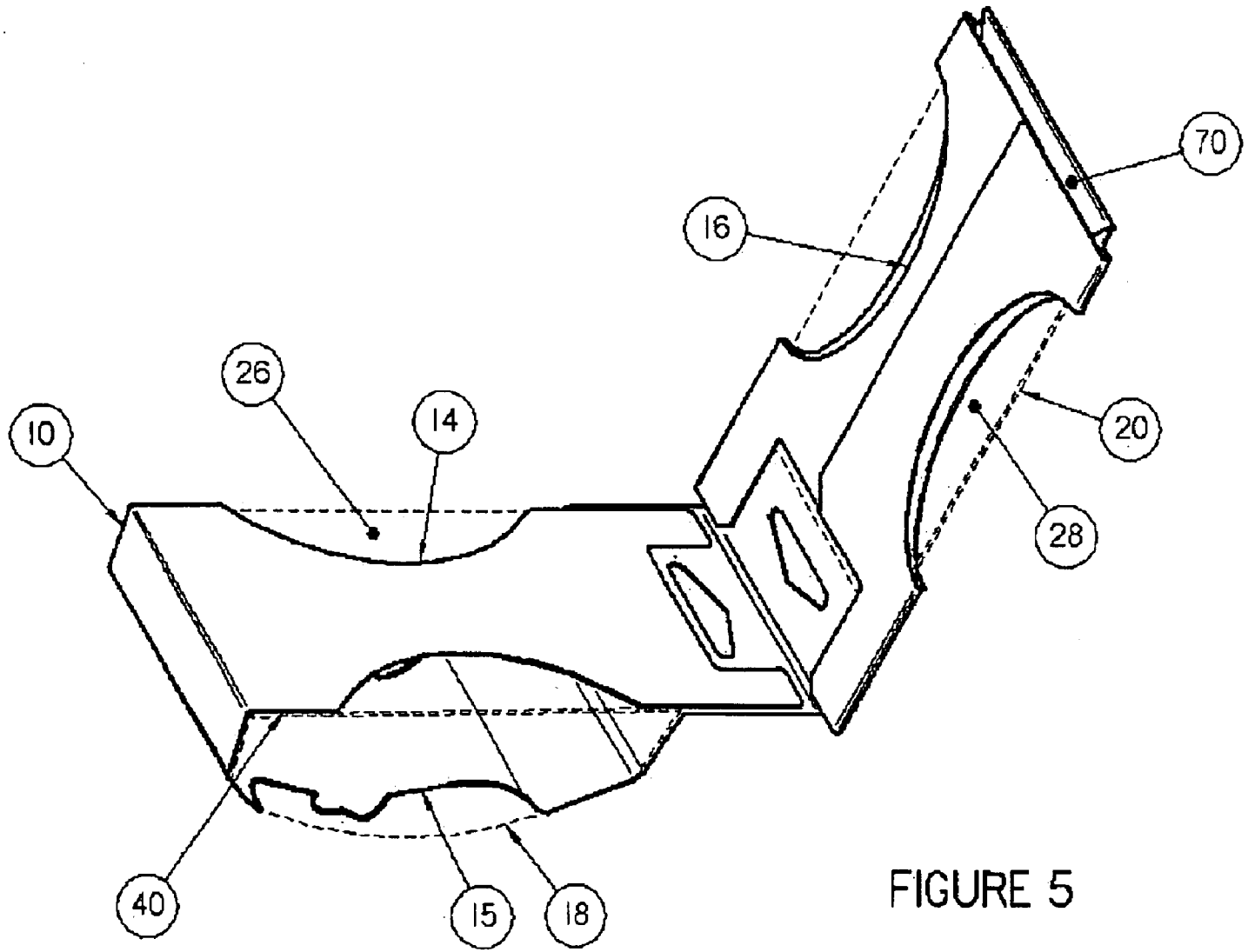
FIG. 5 is a perspective view of the package in an open position as employed in the present invention.

Referring to the drawings, the package of present invention is generally depicted in the FIGURES and is designated by the numeral 10. FIG. 1 depicts the package 10 in an open unassembled form. As seen the package 10 can be formed from a single sheet of card stock 12 and die cut to provide reveal cutout surfaces 14, 15, 16 as seen in FIGS. 1 and 5.

The package 10 can be die stamped/cut to provide a desired retainer for a tool 18, e.g., sanding block, and abrasive material 20, e.g., sanding sheet. The tool 18 has an arcuate top surface portion 22 adapted to be held by one's palm and two side surface portions 24 to be gripped the fingers of one's hand. Also, a bottom surface 26 is provided with one part of a hook and loop fastening material, such as Velcro™. The abrasive material 20 includes top surface 28 which is includes a complementary counterpart of the hook and loop Velcro material which can be fastened to the surface 26 to provide a working abrasive tool.

From left to right as seen in FIG. 1, the package 10 in its unassembled state includes a first package portion 30 for retaining the tool 18 when assembled. Also, a second package portion 32 connects to the first package portion 30 for retaining the abrasive material 20.

The first package portion 30 includes a first cover portion 34 having a first end 36 with a cutout surface 38 centrally positioned therein, sides 40 have reveal cutout surfaces 14. An intermediate strip 42 is formed by transversely stamped fold lines 44 and connects to the portion 34.

Figure 3:
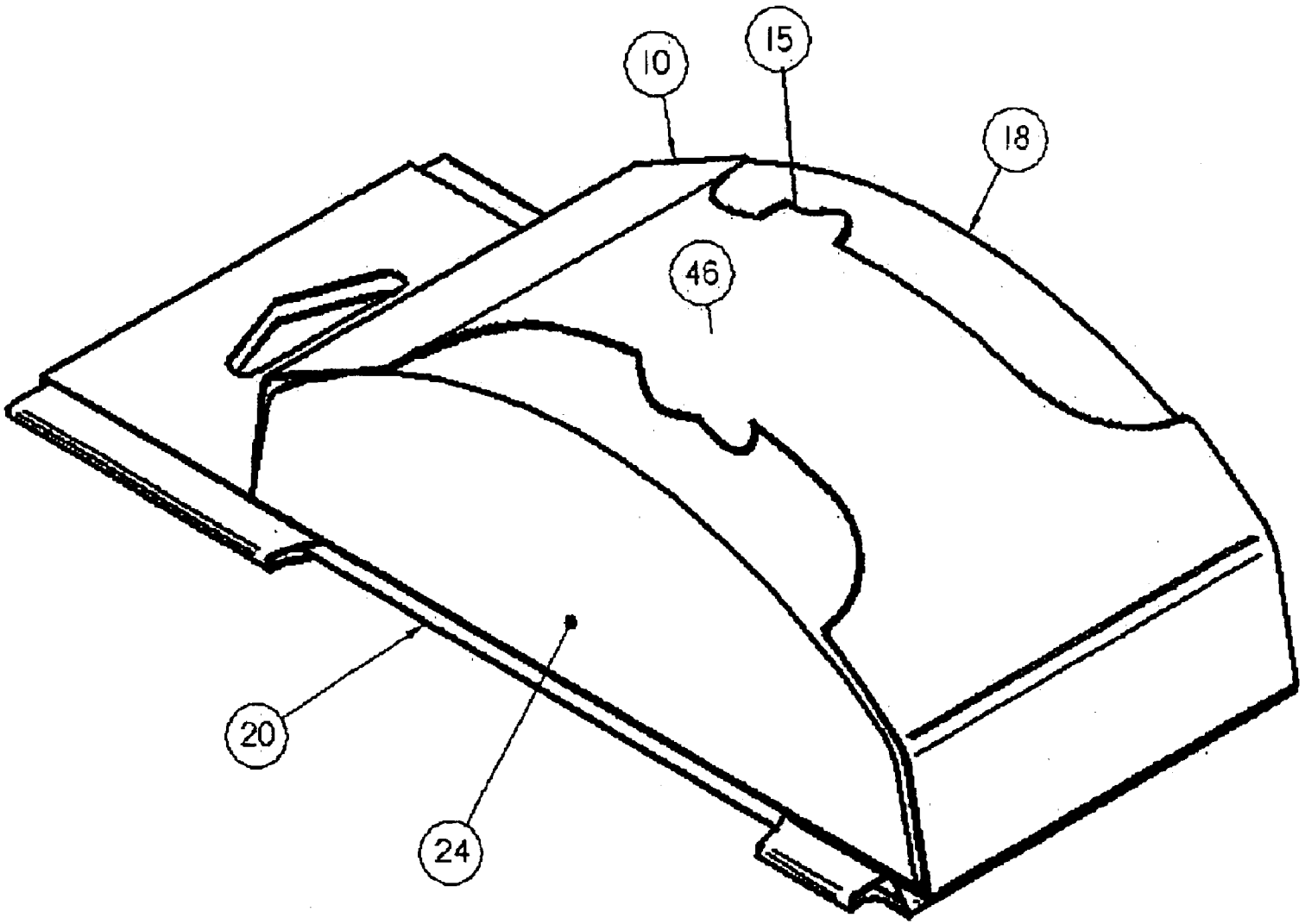
FIG. 3 is a perspective view of the package in a closed position as employed in the present invention.

The cover portion 46 connects to intermediate strip 42 and similarly has sides 48 with reveal cutout surfaces 15 therein. The portion 46 forms a front of the package 10 when assembled as seen in FIG. 3 and the cutout surfaces 15 can include a more fanciful design to permit advertising indicia to be placed thereon.

A second intermediate strip 50 is formed by transversely stamped fold lines 52 and connects to the portion 46. A terminating tab 54 connects to the strip 50 and has an eyelet 56 die cut formed therein which enables the package 10 to be hung on a display hook. The cover portion 30 is folded such that remaining end portions 37 are disposed adjacent either side of the eyelet 56 and secured to the tab 54 by a suitable adhesive material thereby forming an opening to receive the tool 18.

Further, connected to the tab 54 is the second package portion 32. The second package portion 32 includes a first abrasive material cover portion 60. Near the tab 54 is die cut formed another eyelet 62 which is positioned in a mirror like manner from fold line 64 to align with eyelet 56 when package portion 32 is folded adjacent package portion 30. Further, package portion 32 includes longitudinal fold lines 66 which are intersected by reveal cutout surfaces 16. Side flap portions 68 can be folded over fold lines 66 to contact each other and likewise secured by a suitable adhesive material. An end flap portion 70 is provided, wherein the flap portion 70 can be folded over transverse fold line 72 and tucked under the side flap portions 68 to aid in retaining the abrasive material 20.

Figure 2:
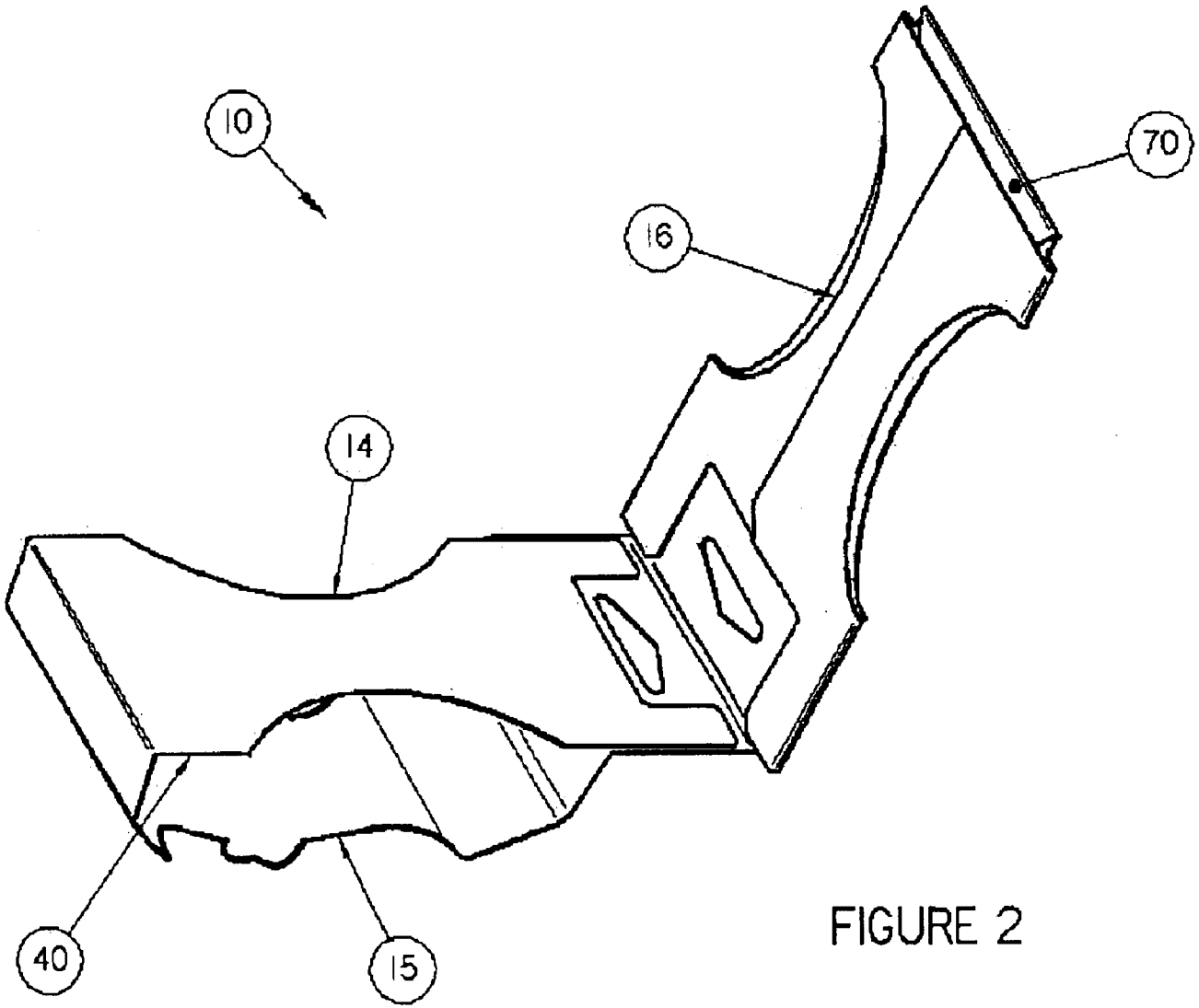
FIG. 2 is a view of the package of FIG. 1 in an assembled form.
Figure 4:
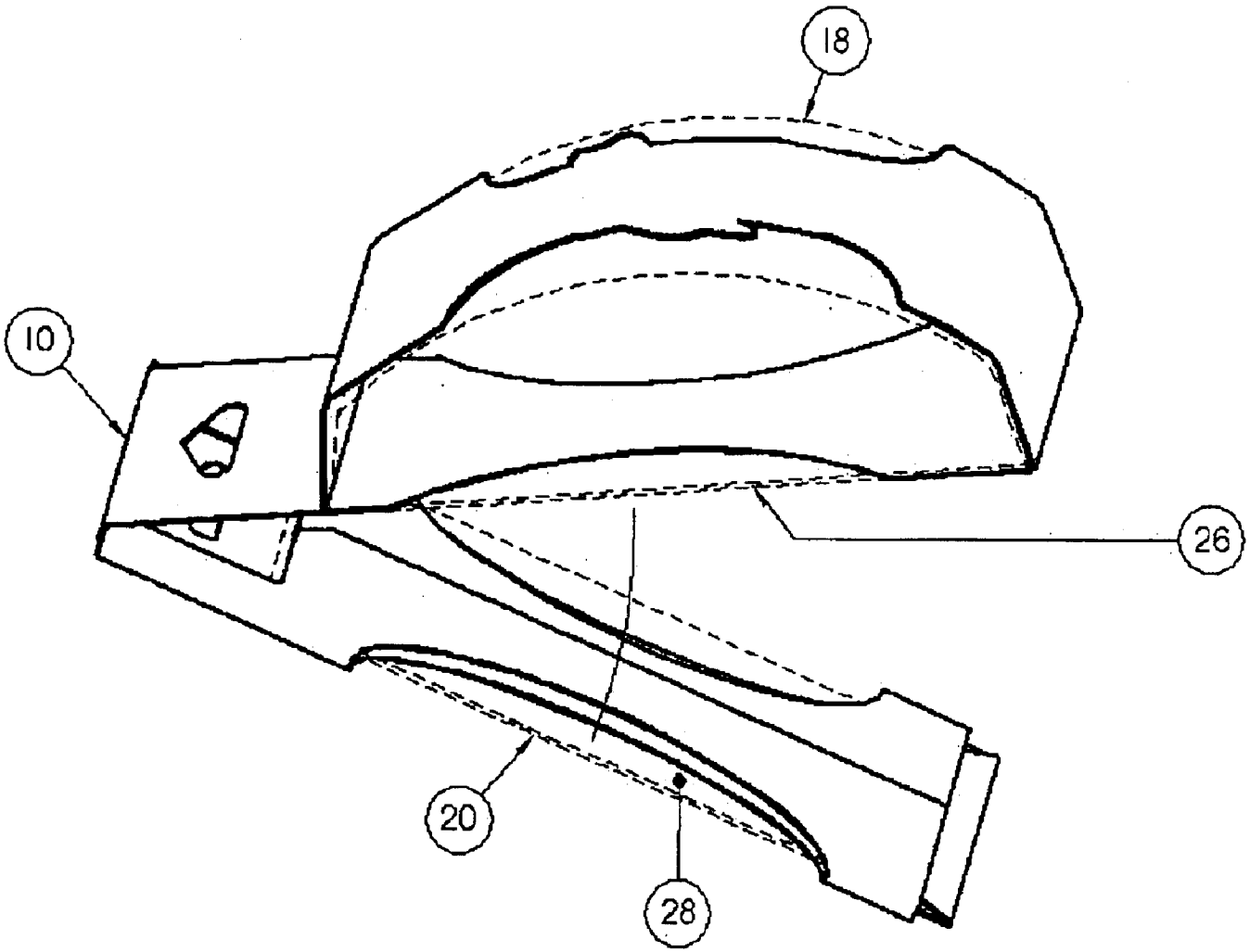
FIG. 4 is a perspective view of the package in a partially open position as employed in the present invention.

Thus, FIG. 2 is a view of the package of FIG. 1 in an assembled form. FIG. 3 is a perspective view of the package in a closed position as employed in the present invention having the tool 18 and abrasive material 20 therein. FIG. 4 is a perspective view of the package in a partially open position showing the abrasive material 20 partially attached to the tool 18. FIG. 5 is a perspective view of the package in an open position as employed in the present invention having the tool 18 and abrasive material 20 therein.

While a preferred embodiment has been set forth above, it is intended only to present the invention in an embodiment. It will be readily apparent to those skilled in the art that many obvious modifications, derivations, and improvements exist and are intended to be included within the scope of the invention and appended claims hereto.

What is claimed is:

1. A package which demonstrates utility of two cooperating attachable pieces including a first cooperating attachable piece having a releasable connecting surface thereon and a second cooperating attachable piece having a releasable connecting surface thereon for connection with the other releasable connecting surface, which comprises:

a first package portion for retaining the first cooperating attachable piece, wherein said first package portion includes a reveal surface to expose part of the first cooperating attachable piece releasable connecting surface;

a second package portion for retaining the second cooperating attachable piece, wherein said second package portion includes a reveal surface to expose part of the second cooperating attachable piece releasable connecting surface; and wherein said first package portion retains the first cooperating attachable piece without the aid of said second package portion and said second package portion retains the second cooperating attachable piece without the aid of said first package portion such that when the cooperating attachable pieces are so retained said releasable connecting surfaces are connected to one another through said reveal surfaces which when so connected releasably retain said package portions adjacent one another.

2. The package of claim 1, wherein said first package portion and said second package portion are connected at adjacent ends thereof.

3. The package of claim 2, wherein said package portions are integrally connected.

4. The package of claim 2 which is characterized to permit said package portions to fold onto each other in a manner such that said reveal surfaces align.

5. The package of claim 1, wherein each said package portion includes multiple reveal surfaces.

6. The package of claim 1, wherein at least one of said package portions includes a tab portion having an eyelet formed therein.

7. The package of clam 1, wherein said first package portion includes the first cooperating attachable piece having a tool for aiding in abrading and said second package portion includes the second cooperating attachable piece having a piece of abrasive material.

8. The package of claim 7, wherein said tool is a sanding block and said abrasive material is a sheet of sandpaper.

9. The package of claim 8, where the releasable connecting surface of the sanding block includes one part of a hook and loop fastening article and the releasable connecting surface of the sheet of sandpaper includes another part of a said fastening article.

10. The package of claim 1, wherein the releasable connecting surface of the the first cooperating attachable piece includes one part of a hook and loop fastening article and the releasable connecting surface of the second cooperating attachable piece includes another part of said fastening article.

* * * * *